United States Patent [19]

Brandenberger et al.

[11] 4,186,896

[45] Feb. 5, 1980

[54] APPARATUS FOR BALLOON LIMITING AT A BOBBIN CREEL

[75] Inventors: Albert Brandenberger, Oberuzwil; Manfred Bollen, Zuzwil, both of Switzerland

[73] Assignee: Maschinenfabrik Benninger AG, Uzwil, Switzerland

[21] Appl. No.: 949,765

[22] Filed: Oct. 10, 1978

[30] Foreign Application Priority Data

Oct. 24, 1977 [CH] Switzerland ..... 12933/77

[51] Int. Cl.[2] ..... B65H 49/14; B65H 57/22

[52] U.S. Cl. ..... 242/131; 57/356

[58] Field of Search ..... 242/131, 131.1, 140, 242/157 R, 172, 35.5 R; 57/106, 107, 354, 356, 357

[56] References Cited

U.S. PATENT DOCUMENTS

| | | | |
|---|---|---|---|
| 3,070,325 | 12/1962 | Porter | 242/128 |
| 3,637,160 | 1/1972 | Hori et al. | 242/131 |
| 3,664,602 | 5/1972 | Renzi | 242/131 |
| 3,718,296 | 2/1973 | Mahoney et al. | 242/35.5 R |
| 3,848,829 | 11/1974 | Womer | 242/131 |
| 3,873,043 | 3/1975 | Wildi et al. | 242/131.1 |

*Primary Examiner*—Stanley N. Gilreath
*Attorney, Agent, or Firm*—Werner W. Kleeman

[57] ABSTRACT

An anti-ballooning apparatus for a bobbin creel arranged between a bobbin mounted upon a bobbin holder of the creel and the thread guide and thread monitoring device operatively associated with such bobbin. The anti-ballooning apparatus prevents contact and/or entanglement of the thread balloon formed during withdrawal of the thread from the bobbins of the creel. This anti-ballooning apparatus comprises two parallel rods located at the central region between the thread guide and monitoring device and the bobbin and extending in a plane perpendicular to the thread withdrawal direction. These two parallel rods can be moved out of their functional or operational position parallel to themselves away from the bobbin holder into a manipulation position where their spacing from the end of the bobbin holder renders possible withdrawal or doffing of a bobbin mounted on the holder and equally donning a bobbin onto such holder.

9 Claims, 7 Drawing Figures

2 / 3

Fig. 5
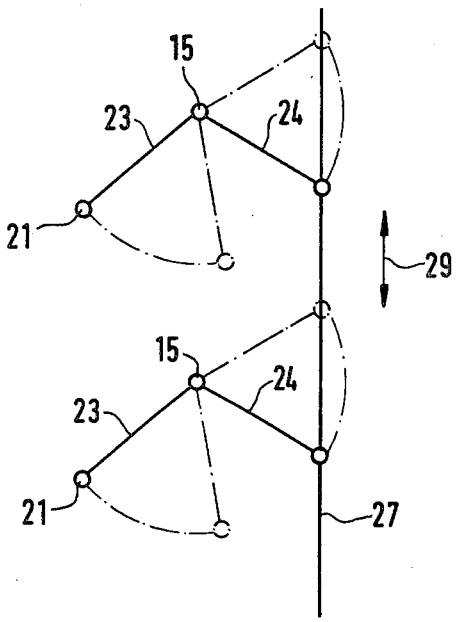
Fig. 6
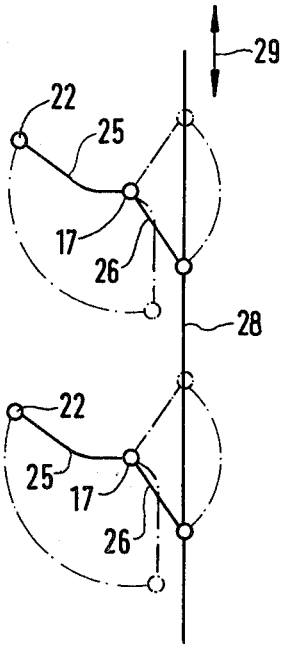
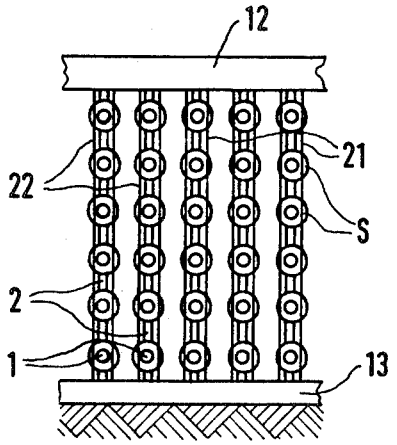
Fig. 7

APPARATUS FOR BALLOON LIMITING AT A BOBBIN CREEL

BACKGROUND OF THE INVENTION

The present invention relates to a new and improved construction of apparatus for balloon limiting at a bobbin creel, also referred to in the art as an anti-ballooning apparatus.

The anti-ballooning apparatus of the invention, which limits the formation of thread balloons at a bobbin creel, is arranged, in each case, between a bobbin which is mounted or donned onto a bobbin holder of the creel and the thread guide and thread monitoring device operatively associated with such bobbin and prevents contact and/or entanglement of the thread balloon which is formed during withdrawal of the threads from the bobbins of the creel.

Modern high production warping plants enable high operating speeds, without straining or rough handling the threads by excessive thread tension. Apart from the strength of the thread or the like, also predominantly responsive for the maximum speeds which can be employed are the operating conditions which constitute some of the most important parameters governing the maximum speed of operation. Thus, for instance, the formation of ballons when working with coarse materials, especially coarse rotor yarns, particularly must be taken into account. Heretofore known anti-ballooning and constricting devices, as a general rule, are located at the region of the bobbins or between the bobbin and tensioner. Depending upon the nature of the device they can hinder the visual and manual access to the bobbins, such as, for instance, the donning and doffing of the bobbins during batch or good change operations, the location of empty running bobbins as well as the removal of a thread rupture.

Frequently, the heretofore known anti-ballooning apparatuses are dependent upon the pitch or distribution of such equipment, so that different bobbins, different bobbin numbers and different spacing between the bobbins, require different balloon limiting or anti-ballooning apparatuses. This requires maintaining in storage a multiplicity of anti-ballooning apparatuses. Hood-shaped balloon limiters additionally impair, to a great degree, the visual access of the machine, and furthermore, for each manipulation carried out at a bobbin frequently must be removed with considerable effect. This is equally so for the heretofore known balloon limiting ring, for instance as taught in Swiss Pat. No. 384,429. After performing the requisite manipulations it is additionally necessary, following the placement of the balloon limiter back into operation, to again thread-in with considerable effort the thread. The attachment elements for the individual balloon limiters frequently form at the region of the thread balloon projections and edges at which the thread can become caught or damaged and, further, at which contaminations can undesirably deposit.

SUMMARY OF THE INVENTION

Hence, with the foregoing in mind it is a primary object of the present invention to provide a new and improved construction of apparatus for limiting the formation of balloons at a bobbin creel in a manner not associated with the aforementioned drawbacks and limitations of the prior art proposals.

Another and more specific object of the present invention aims at the provision of a new and improved construction of anti-ballooning apparatus of the previously mentioned type which, with the most simple mounting possibilities, even at already existing creels, hardly imparts the visual or optical checking of the thread travel between the bobbin and the thread stop motion.

A further object of the present invention, and in keeping with the immediately preceding object, is to devise an apparatus of the previously mentioned type which, for the purpose of carrying out manipulations at the bobbins or the thread, can be removed with a minimum of effort from the manipulation region, and thereafter, again brought into its functional or operational position, without requiring any threading-in or threading-out of the thread or the like and, which at the thread region, does not have any points of attack which could damage the thread or cause thread entanglement or entrapment.

Now in order to implement these and still further objects of the invention, which will become more readily apparent as the description proceeds, the anti-ballooning apparatus of the present development is manifested by the features that it comprises two parallel rods dispositioned at the central region between the thread guide and monitoring device and the bobbin in a plane extending perpendicular to the thread withdrawal direction. These two parallel rods can be pivoted out of this functional position, parallel to themselves, away from the bobbin holder into a manipulation position where their spacing from the end of the bobbin holder renders possible a withdrawal or doffing of a bobbin which has been donned onto the holder and equally a donning of a bobbin onto such holder.

This construction of the inventive apparatus, firstly, has the advantage that it is constructionally extremely simple, and that the rods do not present any points of attack where the thread balloon which is limited between the rods can become caught or damaged. Additionally, these rods only disturb to a minimum the important optical checking or control of the region between the bobbin or spool rack and the brake rack of a bobbin or warping creel and their susceptibility to contamination is exceptionally small. Further, both of the rods forming a balloon limited for all bobbins of a creel arranged in a vertical row with respect to one another can be pivotable above the lowermost and above the uppermost bobbin—in other words externally of the creel—by means of a respective pivoting or rocking lever, each of which are pivotable about a respective stationary pivot shaft or axis, and specifically, especially advantageously in the manipulation position to the region of a profile or sectional element carrying the thread guide and monitoring devices of the creel. Thus, they extensively leave free the region between such profile or structural element and the bobbin holder and also the space between neighboring profile or structural elements. This, in turn, appreciably facilitates performance of the requisite manipulations or working operations, especially the exchange of the bobbins or spools which can be accomplished between two neighboring profile elements. In the functional or operative position of all of the rods of a creel, with this construction, the region or space which is to be completely optically controlled or checked is free of any actuation elements for the rods. Furthermore, such design facilitates the drawing of the threads into their guide and monitoring devices, which, can be accomplished in one operation for all bobbins of a vertical row without any hinderance through the balloon limiter.

It is advantageous if the bearing blocks for the pivotal mounting of the pivoting or rocking levers are combined, for example, all of the bearing blocks for the upper mounting arrangement are secured at a rail which is detachably connected with the creel. In this way the entire balloon limiting system of a creel can be easily assembled and disassembled in the shortest amount of time, and furthermore, it is possible in this manner to equip existing creels subsequently with anti-ballooning equipment constructed according to the invention.

The balloon limiting rods can be individually rocked manually from the one into the other position, and advantageously, the end or terminal positions can be fixed by latches or springs or equivalent structure, or, also a number of rods, for instance even all of the rods of a creel or at one side of a creel can be rocked by a motor or drive at the same time out of the function position into the manipulation position or vice versa.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 2 is a horizontal sectional view, like the showing of FIG. 1, with the inventive anti-ballooning apparatus in a position enabling manipulations to be carried out, for instance for exchanging the bobbins or spools or the like;

FIGS. 5 and 6 are schematic views which respectively show a variant construction of the invention simultaneously enabling the adjustment of all of the inventive anti-ballooning apparatuses of a creel; and FIG. 7 schematically illustrates a section of a bobbin or warping creel in a front view from the side of the here omitted brake rack towards the bobbin or spool rack.

DETAILED DESCRIPTION OF THE PREFERRED EMBODIMENTS

Figure 1:
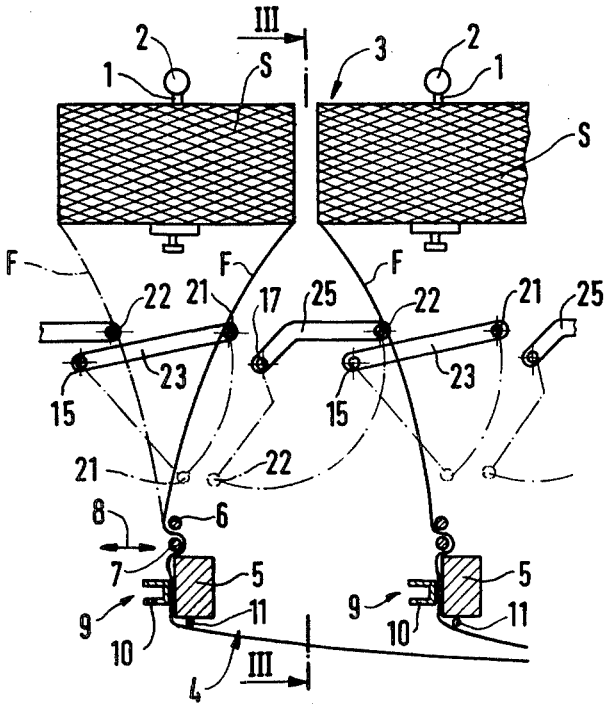
FIG. 1 is a horizontal sectional view through a region of the bobbin rack and brake rack of a bobbin or warping creel encompassing two bobbins and equipped with the inventive anti-ballooning apparatus portrayed in its functions or functional position.

Describing now the drawings, the warping or beaming creel shown therein is of known construction, and the bobbins or spools S are donned in conventional manner upon horizontally arranged bobbin pins or skewers 1 which protrude away from a vertical support tube 2. A plurality of overlying ones of such support tubes 2, and therefore not visible in the showing of FIG. 3, from the so-called bobbin rack which has been generally designated by reference character 3.

This bobbin rack 3 can be fixedly mounted, or, as is the case with the so-called V-shaped creels, the vertical support tubes 2 can in each case be connected at their ends with a circular chain which can be adjusted in a horizontal plane. An appreciable advantage of such creels resides in the fact that the bobbins, during the working procedures, can be newly donned, and that after there has occurred depletion of the bobbins such can be collectively exchanged at one time in that the exhausted or depleted bobbins can be transported away by means of the chain out of their work position, and at the same time the new bobbins or spools, which have been donned during the winding of the now empty bobbins, are guided into their work position.

It is to be appreciated that with this type of creel, after the exchange operation, the threads of all bobbins again must be drawn into the thread guide and monitoring devices. This presupposes that such device not only fulfills the usual requirements, namely allows for high withdrawal speeds with low tension and with slight risk of thread rupture, but furthermore, that it also renders possible a rapid and simple drawing-in of the threads.

To simplify the illustration there have been shown in the Figures for each support or carrier tube 2 only a few of the bobbins above or adjacent one another, respectively, but it should be however understood and self-evident that such number normally is appreciably greater.

Figure 3:
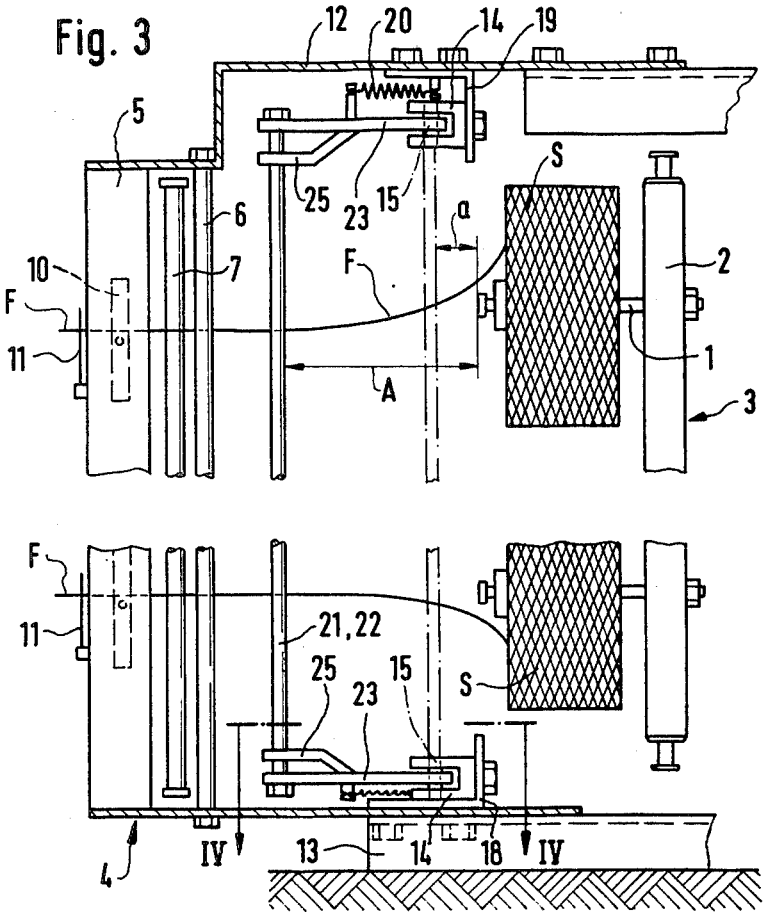
FIG. 3 is a vertical sectional view, taken substantially along the plane defined by the line III—III of FIG. 1, wherein the bobbin rows between the lowermost and uppermost bobbin row are cut-away.

The filamentary material, namely the threads or yarns F—hereinafter simply referred to as threads—withdrawn during operation from the bobbins or spools S each individually pass a thread monitor or stop motion, and, if desired, thread brakes, which constitute components which normally are grouped together at the so-called brake panel or rack 4, as for the illustrated creel. Those individual devices for guiding and monitoring as well as, if desired, braking the threads F withdrawn from the bobbins S, and forming in the creel a vertical row, are arranged at a vertical profile or sectional element 5 of the brake rack 4. In the embodiment under discussion these devices encompass a pre-brake rod pair 6, 7. The pre-brake rod 6 is stationarily mounted, whereas the pre-brake rod 7 advantageously is adjustable parallel to itself, in the direction of the arrow 8 of FIG. 1, in order to be able to change the deflection of the thread F between null and a maximum deflection, this deflection being brought about by the rod pair 6, 7. Furthermore, there is provided a thread clamping device 9. The latter may be advantageously of the type as disclosed in Swiss Pat. No. 555,905 to which reference may be readily had and the disclosure of which is incorporated herein by reference. It encompasses for each thread a clamping plate 10 which can be pressed by means of its clamping surface against a counter surface of the profile element 5 and raised therefrom. During normal operation of the creel the clamping gap, through which the thread is guided, is open, i.e., the thread passes without hinderance the clamping device. If the installation is brought to standstill, for instance in the event of a thread rupture, or, if the bobbins have been depleted, then the clamping plate 10 is pressed against the profile element 5 and thus clamps the thread. Since this is simultaneously the case for all clamping devices of the creel, by virtue of these devices, upon standstill of the installation, the entire thread field is held in a tensioned state. Finally, a thread stop motion for each thread is provided at the brake rack, such thread stop motion or monitor can be of any random known construction. In the exemplary embodiment under discussion this thread stop motion, as for instance apparent from the showing of FIG. 3, is constituted by a feeler-pivot needle 11.

The threads F of the adjacent and superimposed arranged bobbins or spools S of the bobbin rack or panel 3 are all simultaneously withdrawn from a not particularly illustrated but conventional winding machine, for instance a warping or beaming machine. As is known, the threads F, at the region between their bobbin S and their thread brake and monitoring devices at the brake rack 4 experience oscillations, and thus, form the so-called thread bobbins. The size, especially the diameter of a thread balloon which has not been broken-up, depends upon the withdrawal speed, the nature of the thread and the spacing between the bobbins and thread stop motion. This balloon can become so large in size that the threads of two neighboring bobbins S strike one another, resulting in thread damage, with thread entanglement leading to thread rupture, but, as a rule, at least to irregularities in the thread withdrawal operation.

In order to prevent such the illustrated bobbin or warping creel is beneficially equipped with the subsequently to be described balloon limiting apparatuses, the so-called anti-ballooning apparatuses, which, in contrast to heretofore known balloon limiting devices, possess considerable advantages.

Between a stationary uppper balloon limiting part or element 12 of the creel and stationary lower balloon limiting part or element 13 of the creel there are arranged in spaced relationship from one another for each vertical bobbin row two vertical rods 21 and 22. Tests have shown that a spaced pair of such rods 21 and 22 arranged at the central region between the bobbin and thread stop motion or thread monitor are sufficient for breaking-up the formation of a balloon to such an extent that the balloon no longer can exert any disadvantageous effect upon the thread tension, and that the rupture of the balloon, accomplished by the pair of rods 21 and 22, not only is effectively prevented in lateral direction, where, of course, the expansion of the balloon is bodily limited by these rods 21 and 22, but also in vertical direction where there does not occur any limiting action.

Now in FIGS. 1 and 7 the rods 21 and 22 have been shown in their functional position in full lines. This position has been illustrated in FIG. 3 in broken lines. In this position both of the rods 21 and 22 of an associated and coacting pair of rods limit the diameter of the ellipsoid-shaped envelope curve which is produced by each thread F passing between these rods 21 and 22 during the balloon formation without such rods. The spacing between both of the rods 21 and 22 of a rod pair in the function position amounts to advantageously about 14 centimeters. This enables, during drawing-in of the threads manually between the rods, to pull-in with one hand the threads of a vertical bobbin row which are to be drawn-in and with one operation to draw such threads through the related devices of the brake rack.

However, it also happens that for eliminating the cause of the operational interruptions, for instance for eliminating thread ruptures, for replacement of faulty bobbins or similar devices, it is necessary to carry out manipulations in the space between the brake rack and bobbin rack, where the rods 21 and 22 constitute a hinderance when in their aforementioned function or operational position. It will be especially seen from the showing of the drawings that with the rods 21 and 22 in their function position it is not possible for instance to withdraw or doff a bobbin S from its bobbin pin or spindle 1 and to don a bobbin S upon such spindle 1.

In order to render this possible the rods 21 and 22 which extend perpendicular to the axis of the bobbins S and the bobbin spindle 1 are arranged each to be movable parallel to themselves away from the bobbin holder and pivotable in a direction towards the brake rack. In the bobbin remote-end position of this pivotal movement, shown in broken lines in FIG. 1, but in full lines in FIGS. 2 and 3, both of the rods 21 and 22 travel towards the region of the related profile or sectional element 5 of the brake rack 4. Further, their spacing from the end of the bobbin pin or bobbin spindles 1 of the related vertical spool or bobbin row has increased from the value a to the value A (FIG. 3), i.e., to a value which renders possible the withdrawal of a bobbin S from or the mounting or donning of a bobbin onto a bobbin pin or spindle 1 between and through two neighboring profile elements 5 without hinderance by the rods 21 and 22.

Each of the rods 21 and 22 is connected, for this purpose, at its ends with the free end of a pivotal lever 23 for the rods 21 and a pivotal lever 25 for the rods 22, these pivotal levers 23 and 25 extending perpendicular to the rods 21 and 22.

Both of the pivotal levers 23 which, in each case, guide a rod 21 at the top and at the bottom, as the case may be, are extended and each pivotably mounted at their end remote from the rod in a bearing block 14 for pivotal movement about a vertical axis 15.

Both of the pivotal levers 25 which, in each case, guide a rod 22, are offset and bent and pivotably mounted at their end remote from the rod 22 each in a bearing block 16 or equivalent structure for pivotable movement about a vertical axis 17.

All of the bearing blocks 14 and 16 for the lower rod guides are attached to an angle rail 18 which, in turn, is threadably connected with the stationary frame portion 13 of the creel.

Equally, all of the bearing blocks 14 and 16 for guiding the upper ends of the rods 21 and 22 are attached at a common angle rail 19, which, in turn, is threadably connected or otherwise affixed with the stationary part 12 of the creel.

Consequently, it is easy to assemble and disassemble the described apparatus for balloon limiting in its entire structure at a creel, especially, however, to equip already existing bobbin or warping creels, with very few modifications and with slight expenditure, with such anti-ballooning equipment.

Figure 2:
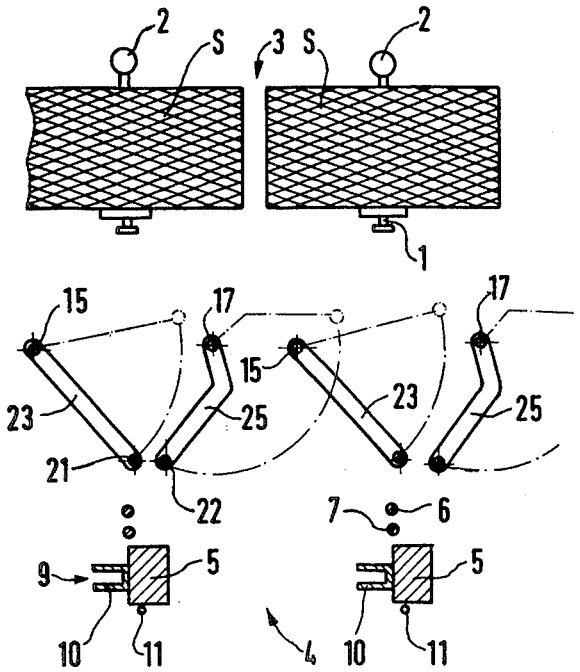

The requisite rocking or pivoting of the selected rods 21 and 22 needed for carrying out a desired manipulation, for instance, the exchange of a given bobbin or spool, out of the function position, shown in FIG. 1, into the manipulation position, shown in FIG. 2, can be accomplished manually. In accordance with a further modification of the invention, to be explained more fully hereinafter in conjunction with FIGS. 5 and 6, it is possible however to also simultaneously displace all rod pairs 21, 22 of a creel or a creel side from one end position into the other end position.

If there is contemplated manual and individual actuation, then, it is advantageous to releasably fix both end or terminal positions of the rods.

Figure 4:
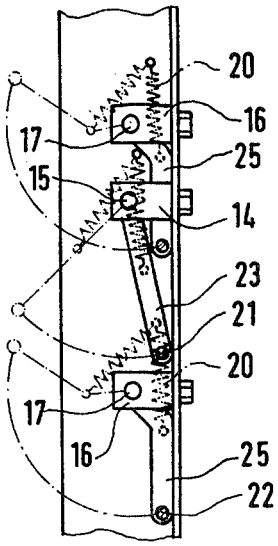
FIG. 4 is a sectional view taken substantially along the line IV—IV of FIG. 3, however with the inventive anti-ballooning apparatus shown in its function position according to the illustration of FIG. 1.

Now in FIGS. 3 and 4 there has been shown, purely by way of example while utilizing tension springs 20, a particularly simple type of such fixation, these tension springs, in known manner, being secured at one end of the relevant pivotal lever and at the other end at a stationary creel part, so that upon rocking of the pivotal lever from one end position into the other end position they are stretched beyond a dead-center point.

What is further possible and conceivable would be, of course, to also provide for a releasable fixation of the end positions of the rods 21 and 22 by resilient stops, latches or the like.

With the already mentioned variant embodiment according to FIGS. 5 and 6, by virtue of which all of the rods 21 and 22 of a creel or a creel side are simultaneously moved from their function or operational position into the position for manipulations and back again, all of the pivotal levers 23 carry a projection 24, as best seen by referring to FIG. 5, and further, all of the pivotal levers 25 carry a projection 26. These projections 24 and 26 or equivalent structure together with the related pivotal levers form, in each case, an angle lever through whose apex there extends the pivot axis. The ends of all projections 24 opposite such pivot axis are articulated at a thrust or push rod 27 and in the same manner the free ends of the projections 26 are articulated or hingedly connected at a thrust or push rod 28.

If these thrust or push rods 27 and 28 are conjointly or individually axially displaced in the direction of the arrow 29, which can be accomplished manually or by a motor drive of any suitable type, then as a result thereof, as will be readily apparent, all of the therewith connected rods 21 and 22 are simultaneously adjusted in the aforementioned manner between their function position and manipulation position.

The use of rods for limiting balloon formation, apart from the already mentioned advantage of less impairment of the optical checking and the simpler construction, has a further advantage, the low susceptibility to contamination and disturbance and the low wear which additionally can be further reduced by application of a suitable surface protective layer or coating, for instance by chrome plating these rods.

While there are shown and described present preferred embodiments of the invention, it is to be distinctly understood that the invention is not limited thereto, but may be otherwise variously embodied and practiced within the scope of the following claims.

Accordingly, what we claim is:

1. An anti-ballooning apparatus for a bobbin creel arranged between a bobbin mounted upon a bobbin holder of the creel and a thread guide and thread monitoring device operatively associated with such bobbin, the anti-ballooning apparatus preventing contact, entanglement, or both, of the thread balloon formed during withdrawal of the thread from the bobbins of the creel, comprising:

two parallel rods located at a central region between the thread guide and monitoring device and the bobbin and extending in a plane substantially perpendicular to the direction of withdrawal of the thread from the bobbin;

means mounting said two parallel rods for movement between a functional position and a manipulation position;

said mounting means enabling said two parallel rods to be rocked out of said functional position each parallel to itself away from the bobbin holder into the manipulation position where the spacing from the end of the bobbin holder enables doffing of a bobbin mounted on the bobbin holder and a donning of a bobbin upon such bobbin holder.

2. The apparatus as defined in claim 1, wherein:

both of the rods form a balloon limiting device for all of the bobbins of a creel arranged in a vertical row with respect to one another;

said mounting means pivotably mounting both of said rocks by means of a respected pivotal lever below the lowermost and above the uppermost bobbins; and said mounting means further including means mounting each of said pivotal levers about a stationary pivot axis.

3. The apparatus as defined in claim 2, wherein:

said mounting means comprises a profile element;

said rods, in the manipulation position, being pivotable towards the region of the profile element;

said profile element carrying at least some of the thread guide and monitoring devices of the creel;

said pivotal movement of the rods extensively freeing the region between said profile element and the bobbin holder and the space between neighboring profile elements.

4. The apparatus as defined in claim 3, further including:

bearing block means for the pivotal mounting of the pivotal levers;

rail means at which there are conjointly mounted the bearing block means; and said rail means being detachably connected with said creel.

5. The apparatus as defined in claim 4, wherein:

said pivotal levers are movable between two end positions defining the functional position and the manipulation position of the rods; and means for fixing the pivotal levers in both end positions of their pivoting movement.

6. The apparatus as defined in claim 5, wherein:

said fixing means comprise tension spring means acting upon the pivotal levers;

said tension spring means being arranged such that, upon rocking of each related pivotal lever from the one end position into the other end position each such tension spring means is stretched beyond a dead-center point.

7. The apparatus as defined in claim 2, wherein:

each of said pivotal levers is structured as an angle lever; and means for simultaneously rocking at least all pivotal levers of a creel or a creel side which are operatively associated with said rods which limit the formation of a thread balloon.

8. The apparatus as defined in claim 7, wherein:

said means for simultaneously rocking all of the pivotal levers comprises thrust rod means engaging at the pivotal levers.

9. An anti-ballooning apparatus for a bobbin creel arranged between a bobbin mounted upon a bobbin holder of the creel and thread monitoring means operatively associated with said bobbin, comprising:

two substantially parallel rods located intermediate the thread monitoring means and the bobbin and extending in a plane substantially perpendicular to the direction of withdrawal of the thread from the bobbin;

means mounting said two parallel rods for movement between a functional position and a manipulation position;

said mounting means enabling said two parallel rods to be rocked out of said functional position away from the bobbin holder into said manipulation position where their spacing from the end of the bobbin holder enables doffing of a bobbin mounted on the bobbin holder and donning of a bobbin upon such bobbin holder.

* * * * *